US009181646B2

(12) United States Patent
Feng

(10) Patent No.: US 9,181,646 B2
(45) Date of Patent: Nov. 10, 2015

(54) METHOD OF MANUFACTURING VELVET PLUSH AND ARTICLE THEREOF

(76) Inventor: Chen Feng, City of Industry, CA (US)

( * ) Notice: Subject to any disclaimer, the term of this patent is extended or adjusted under 35 U.S.C. 154(b) by 376 days.

(21) Appl. No.: 13/507,616

(22) Filed: Jul. 12, 2012

(65) Prior Publication Data

US 2014/0013555 A1 Jan. 16, 2014

(51) Int. Cl.

| | |
|---|---|
| ***D06C 27/00*** | (2006.01) |
| ***D03D 27/10*** | (2006.01) |
| ***D06C 29/00*** | (2006.01) |

(52) U.S. Cl.

CPC ..... *D06C 29/00* (2013.01); *D03D 27/10* (2013.01); *D06C 27/00* (2013.01)

(58) Field of Classification Search

CPC ..... D06C 27/00; D06C 19/00; D06C 3/00; D06C 7/02; D06C 9/00; D06C 13/00; D03D 15/00; D03D 27/00; D03D 27/10

USPC ..... 28/159, 160, 165, 169, 162; 26/2 R, 3, 26/4, 29 R, 89, 51; 8/485, 488, 489, 529, 8/494; 139/391

See application file for complete search history.

(56) References Cited

U.S. PATENT DOCUMENTS

| | | | | |
|---|---|---|---|---|
| 1,484,292 | A * | 2/1924 | Boyd | 139/391 |
| 2,706,845 | A * | 4/1955 | Delmar | 26/1 |
| 3,322,606 | A * | 5/1967 | Koller | 428/95 |
| 3,403,433 | A * | 10/1968 | Schoeneberg | 28/162 |
| 3,419,936 | A * | 1/1969 | Sims | 425/461 |
| 3,865,678 | A * | 2/1975 | Okamoto et al. | 428/91 |
| 3,999,940 | A * | 12/1976 | Freeman | 8/449 |
| 4,512,065 | A * | 4/1985 | Otto | 26/28 |
| 4,589,884 | A * | 5/1986 | Gilpatrick | 8/481 |
| 5,685,223 | A * | 11/1997 | Vermuelen et al. | 101/129 |
| 7,428,772 | B2 * | 9/2008 | Rock | 28/159 |
| 2003/0172505 | A1 * | 9/2003 | Kim | 28/159 |
| 2005/0246842 | A1 * | 11/2005 | Jen | 8/115.51 |
| 2007/0124874 | A1 * | 6/2007 | Jin et al. | 8/534 |
| 2011/0287210 | A1 * | 11/2011 | Tung | 428/85 |
| 2012/0255643 | A1 * | 10/2012 | Duan | 139/396 |
| 2012/0260422 | A1 * | 10/2012 | Rock et al. | 5/483 |

* cited by examiner

*Primary Examiner* — Amy Vanatta

(74) *Attorney, Agent, or Firm* — Beeson Skinner Beverly, LLP

(57) ABSTRACT

A method of manufacturing a velvet plush article includes the steps of: weaving a greige cloth by interweaving face yarns and backing yarns, wherein the face yarns are selected from single-ply bright trilobal yarns and two-ply yarns and the backing yarns are selected from FDY or DTY yarn; pre-processing the greige cloth by brushing, first setting, singeing and second setting the greige cloth sequentially; dyeing and/or printing the greige cloth; and finishing the greige cloth by softening, drying, brushing, stentering, heat-setting, singeing, shearing and final heat-setting the greige cloth. Accordingly, a velvet plush article having superior smoothness and softness for providing a superior touch and feel comfort is achieved. The velvet plush article may be a velvet plush throw or blanket, or a velvet plush cloth for further processing.

20 Claims, 3 Drawing Sheets

METHOD OF MANUFACTURING VELVET PLUSH AND ARTICLE THEREOF

BACKGROUND OF THE PRESENT INVENTION

1. Field of Invention

The present invention relates to velvet plush, and more particularly to a method of manufacturing velvet plush throw which utilizes synthetic fiber to produce a particularly soft and smooth velvet plush throw.

2. Description of Related Arts

Velvet plush has a generally soft and smooth texture and is a very popular material used in textiles. Velvet plush throws, blankets, and similar plush textiles are in popular use because they are very smooth and soft. However, the cost to manufacture a velvet plush throw, blanket or the like is very high. Conversely, efforts to manufacture velvet plush throws and blankets at more reasonable cost have resulted in lower quality articles. Materials such as silk, cashmere, mohair, linen and cotton are traditionally used for manufacturing velvet plush. Velvet plush articles produced from silk are especially soft and smooth. Silk, however, is a very expense raw material and is, therefore, less desirable when seeking to contain manufacturing costs. On the other hand, synthetic materials such as polyester and nylon are more reasonable in price, but the quality of a velvet plush cloth made with polyester or nylon is relatively low.

The conventional method for manufacturing a tufted surface involves needling and adding the tufted pile onto a backing, but this technique does not produce a smooth and soft tufted surface of high quality having an evenly distributed pile layer.

There is, thus, no practical cost-effective method in the prior art for the manufacture of a high quality velvet plush throw.

SUMMARY OF THE PRESENT INVENTION

A method of manufacturing a velvet plush article according to the present invention comprises the steps of:

(A) weaving a greige cloth by interweaving face yarns and backing yarns, wherein the face yarns are selected from a group consisting of single-ply bright trilobal yarns having linear mass densities of 75D/144F, 90D/144F, 100D/144F or 150D/288F and two-ply yarns having linear mass densities of 120D/288F or 300D/574F, wherein the backing yarns are selected from fully drawn yarns having weights of approximately 68D-100D or draw textured yarns having weights of approximately 100D-150D;

(B) pre-processing the greige cloth by brushing, first setting, singeing and second setting the greige cloth sequentially;

(C) dyeing the preprocessed greige cloth to form a colored greige cloth; and (E) finishing by softening, drying, brushing, stentering, heat-setting, singeing, shearing and final heat-setting the colored greige cloth.

Alternately, after step (B) or (C), the method of manufacturing a velvet plush article further comprises the steps of:

(D) printing the pre-processed greige cloth obtained from step (B) or printing the colored greige cloth obtained from step (C) to form a printed and colored greige cloth; and (E) finishing by softening, drying, brushing, stentering, heat-setting, singeing, shearing and final heat-setting the colored or printed greige cloth sequentially.

First and a second filaments are provided in step (A) in a ratio of 4:1, respectively.

The brushing in step (B) involves brushing in a frontward direction and in a backward direction; the first setting involves heat-setting at 120-130° C. at a rolling speed of 25 m/min; the singeing involves a sequential rolling for six times at a frontward, backward, backward, frontward, backward and backward directions; the second setting involves heat-setting at 170-180° C. at a rolling speed of 25 m/min.

In step (C), dyeing the greige cloth includes bathing in dye fluid and rinsing in water. In one embodiment of the invention, the greige cloth is dyed for an additional twenty minutes and rinsed in water having a neutral or nearly neutral pH in order to produce a smooth and bright surface.

In step (D), printing includes the steps of brushing in a frontward direction, setting at 150° C. at a rolling speed of 25 m/min, and printing a preset pattern.

In step (E), softening includes washing to add acidity until the greige cloth is soft and then neutralizing the greige cloth until a pH of the greige cloth is neutral. If the pH is lower than 7, the fiber density of the greige cloth will diminish. If the pH is higher than 7, the greige cloth will be overly hardened; drying includes drying under 190° C. at a rolling speed of 20 m/min with an upper drying channel operated at 300 rpm and a lower drying channel operated at 1200 rpm; brushing includes two brushing cycles; stentering includes stentering at a frontward direction and a backward direction; heat-setting includes heat-setting under 150° C. at a rolling speed of 25 m/min with soft air; singeing includes singe rolling in frontward and backward directions, and preferably includes singe rolling in backward, backward, frontward, frontward, backward, frontward, backward and frontward directions sequentially; shearing includes shearing at a frontward, backward, backward, frontward, frontward, frontward, backward and backward directions sequentially such that the final orientation of the pile hair is the same when approaching the cloth in both frontward and backward directions; and final heat-setting includes heat-setting at 190° C. at a rolling speed of 30 m/min.

In accordance with another aspect of the invention, the present invention comprises a velvet plush article, comprising:

a flat body having a middle layer defining a top surface and a bottom surface, and at least one pile layer extended from the middle layer on one of the top surface and the bottom surface, wherein the velvet plush article is made in synthetic materials such as polyester and the pile layer provides a highly smooth and soft touch and feel.

In one embodiment, a color and/or a pattern is provided to the flat body of the velvet plush article. The velvet plush article manufactured according to the method can also be a velvet plush blanket or simply a velvet plush sheet which can be further processed.

The method described above advantageously uses synthetic materials to product a high quality velvet plush article having superior smoothness and a soft hand, employs an automated process which lowers costs and improves quality, and flexibly allows the article to optionally be dyed and printed.

DETAILED DESCRIPTION OF THE PREFERRED EMBODIMENT

Figure 1:
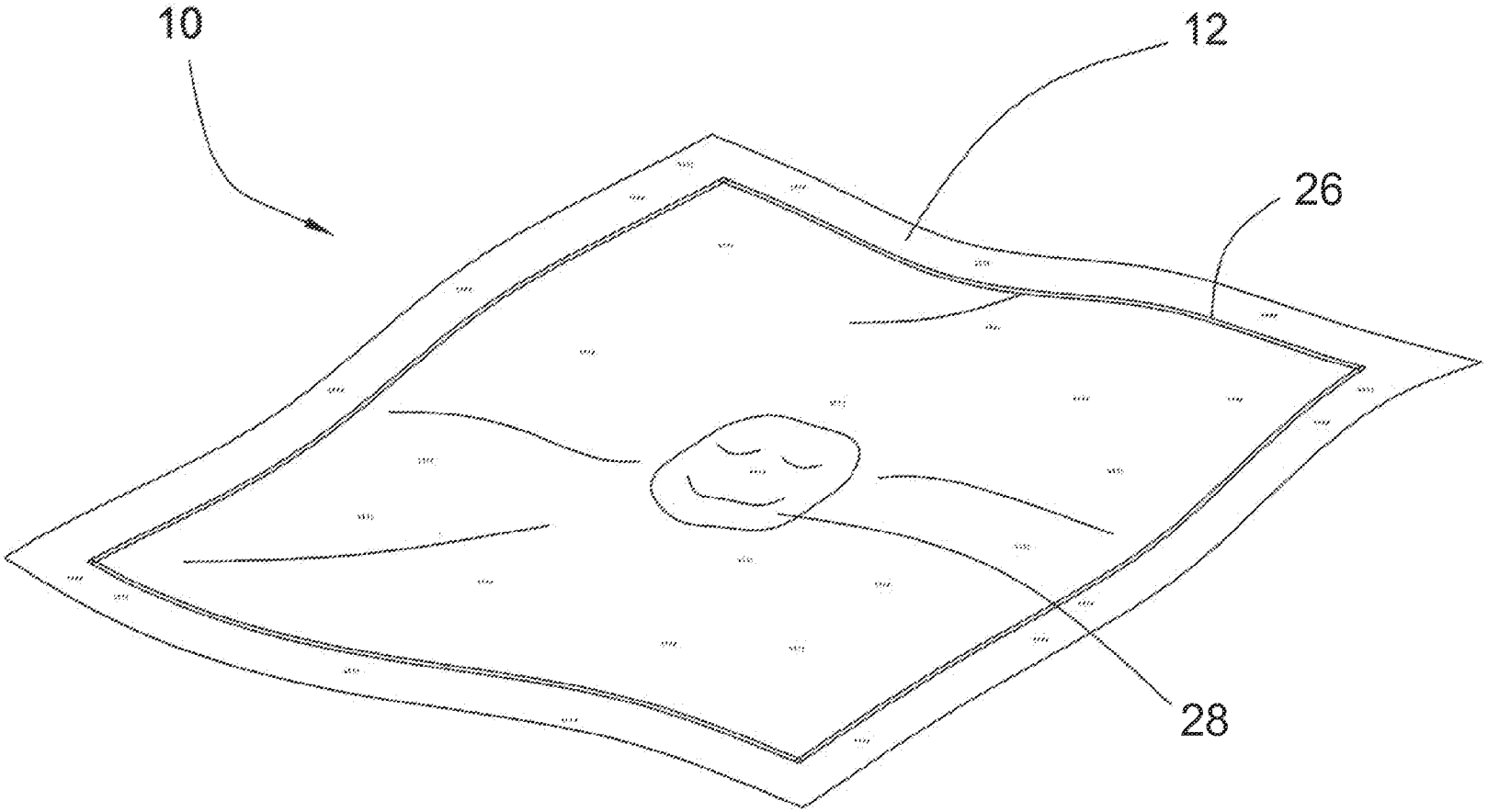
FIG. 1 is an upper perspective view of a velvet plush article according to the invention.
Figure 2:
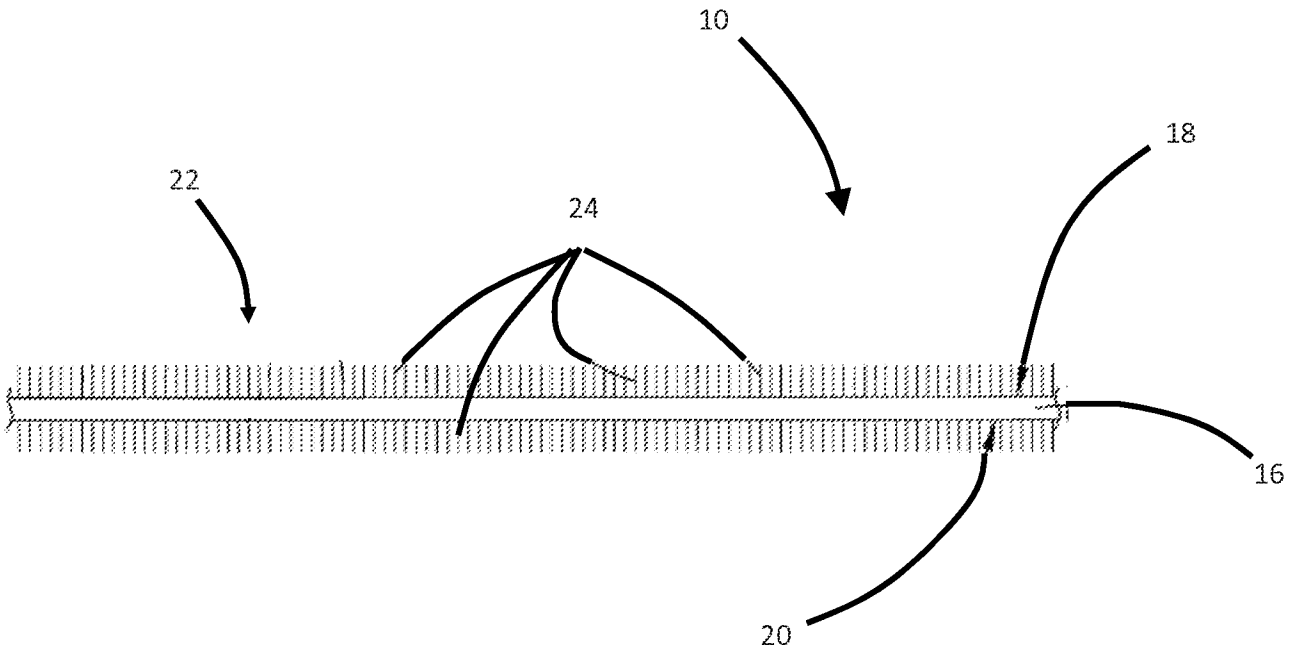
FIG. 2 is an end view thereof.
Figure 3:
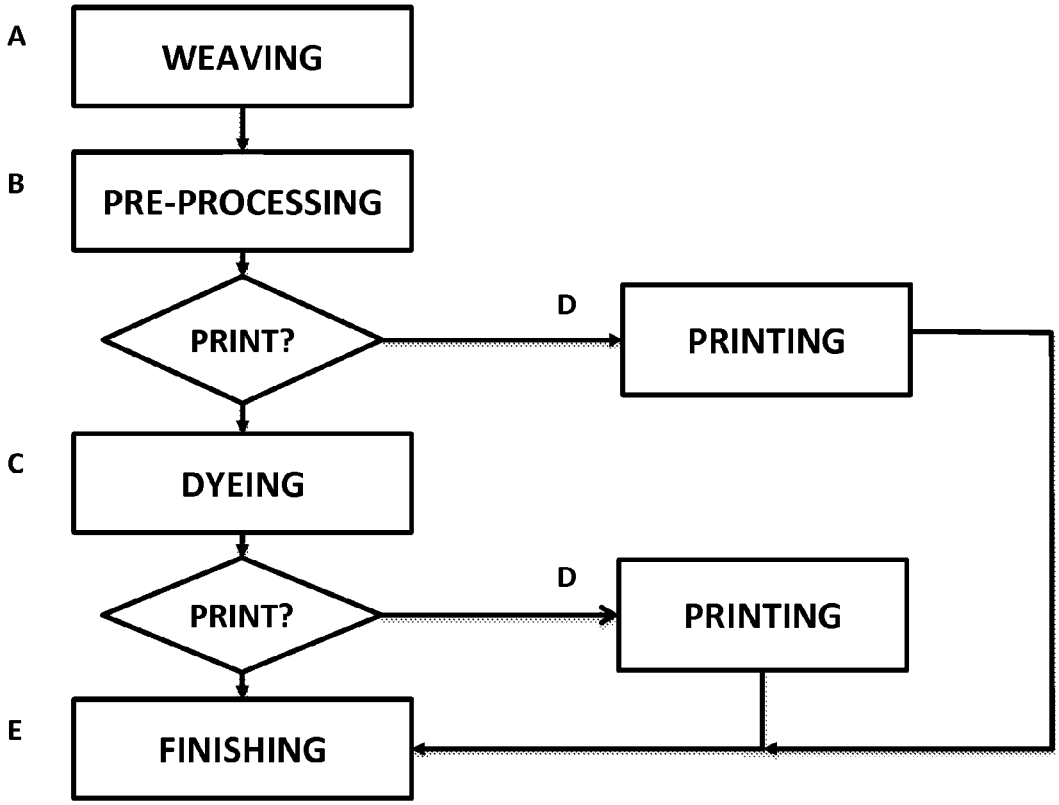
FIG. 3 is high-level flowchart of a method of manufacturing velvet plush article according to the invention.

Referring to FIGS. 1-3 of the drawings, a method of manufacturing velvet plush article and a final velvet plush article are described below. The method of manufacturing a velvet plush article comprises the steps of:

(A) weaving a greige cloth;

(B) pre-processing the greige cloth from step (A);

(C) dyeing the greige cloth after step (B);

(D) printing the greige cloth after step (B) or (C); and (E) finishing the greige cloth to form a final velvet plush article.

The dyeing and printing steps are optional and may be performed as desired in order to provide the velvet plush article with a particular color and pattern.

As shown in FIG. 2, the velvet plush article 10 has a flat body 12 having a middle layer 16 defining a top surface 18 and a bottom surface 20, and at least one pile layer 22 comprising a plurality of pile hairs 24 extending from the middle layer 16 on the top surface 18, the bottom surface 20, or both. The velvet plush article 10 has two pile layers 22 on the top surface 18 and the bottom surface 20 respectively and the pile hair 24 is uni-directional in which a direction of the pile hair 24 at a frontward direction is the same as a direction of the pile hair at a backward direction. The velvet plush article 10 is made of synthetic materials such as polyester and the two pile layers 22 on the top surface 18 and the bottom surface 20 provide a highly smooth and soft touch and feel to a user. In addition, a color 14 and/or a pattern 16 can be provided on one or both of the two pile layers 22 on the top surface 18 and/or the bottom surface 20 as seen in FIG. 1. The velvet plush article 10 can also be manufactured as a velvet plush blanket or a velvet plush sheet for further processing.

As shown in FIG. 3, the method of manufacturing a velvet plush article comprises the steps of:

(A) weaving a greige cloth by interweaving face yarns and backing yarns, wherein the face yarns are selected from a group consisting of single-ply bright trilobal yarns having linear mass densities of 75D/144F, 90D/144F, 100D/144F or 150D/288F and two-ply yarns having linear mass densities of 120D/288F or 300D/574F, wherein the backing yarns are selected from fully drawn yarns having weights of approximately 68D-100D or draw textured yarns having weights of approximately 100D-150D;

(B) pre-processing the greige cloth obtained from step (A) by brushing, first setting, singeing and second setting the greige cloth sequentially;

(C) dyeing the preprocessed greige cloth to form a colored greige cloth; and (E) finishing by sequentially softening, drying, brushing, stentering, heat-setting, singeing, shearing and final heat-setting the colored greige cloth.

Alternately, after the step (B) or (C), the method of manufacturing a velvet plush article further comprises the steps of:

(D) printing the pre-processed greige cloth obtained from step (B) or printing the pre-processed and colored greige cloth obtained from step (C) to form a printed greige cloth; and (E) finishing by softening, drying, brushing, stentering, heat-setting, singeing, shearing and final heat-setting the colored or printed greige cloth sequentially.

Preferably, in step (A), first and second filaments are provided in a ratio of 4:1, wherein the first filament is a backing filament.

In step (B), the brushing involves brushing in a frontward direction and in a backward direction; the first setting involves heat-setting at 120-130° C. at a rolling speed of 25 m/min; the singeing involves a sequential rolling for six times at a frontward, backward, backward, frontward, backward and backward directions; and the second setting involves heat-setting at 170-180° C. at a rolling speed of 25 m/min.

In step (C), dyeing the greige cloth includes bathing in dye fluid and rinsing with water. In one embodiment additional dyeing time of 20 minutes is required due to immersion of the greige cloth in a water bath having a neutral pH or the lowest acidity that will result in a smooth and bright surface.

In step (D), printing includes the steps of brushing in a frontward direction, setting at 150° C. at a rolling speed of 25 m/min, and printing a preset pattern.

In step (E), softening includes washing to add acidity until the greige cloth is soft and then neutralizing the pH of the greige cloth. If the pH is lower than 7, the fiber density of the greige cloth will diminish. If the pH is greater than 7, the greige cloth will be hardened; drying includes drying under 190° C. at a rolling speed of 20 m/min with an upper drying channel operated at 300 rpm and a lower drying channel operated at 1200 rpm; brushing includes brushing two brushing cycles; stentering includes stentering in a frontward direction and a backward direction; heat-setting includes heat-setting under 150° C. at a rolling speed of 25 m/min with soft air; singeing includes passing the greige cloth across hot singe rollers in frontward and backward directions, and preferably includes passing the greige cloth across hot singe rollers in backward, backward, frontward, frontward, backward, frontward, backward and frontward directions sequentially; shearing includes shearing in frontward, backward, backward, frontward, frontward, frontward, backward and backward directions sequentially such that the final orientation of the pile hair is the same when approaching the cloth in both frontward and backward directions; and final heat-setting includes heat-setting at 190° C. at a rolling speed of 30 m/min.

There have thus been described and illustrated certain embodiments of a method of manufacturing velvet plush according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

What is claimed is:

1. A method of manufacturing a velvet plush article, comprising the steps of:

weaving a greige cloth by interweaving face yarns and backing yarns, said face yarns comprising single-ply trilobal yarns or two-ply yarns and said backing yarns comprising fully drawn yarns or draw-textured yarns;

pre-processing by sequentially brushing, first setting, singeing and second setting said greige cloth;

dyeing the pre-processed greige cloth to form a colored cloth; and finishing by sequentially softening, drying, brushing, stentering, heat-setting, singeing, shearing and final heat-setting said colored greige cloth to form a finished velvet plush article having a flat body including a middle layer and two pile layers, each said pile layer having pile hair that is uni-directional, smooth and soft.

2. The method of claim 1 further comprising the steps of:
printing a pattern on said colored cloth, and
performing said finishing step on the printed colored cloth.

3. The method of claim 1 wherein
said single-ply trilobal yarns are selected from the group of yarns having linear mass densities of 75D/144F, 90D/144F, 100D/144F and 150D/288F,
the two-ply yarns are selected from the group of yarns having linear mass densities of 120D/288F or 300D/574F, and
the backing yarns are yarns selected from fully drawn yarns having a weight of 7 approximately 68D-100D or draw textured yarns having a weight of approximately 100D-150D.

4. The method of claim 2 wherein
said single-ply trilobal yarns are selected from the group of yarns having linear mass densities of 75D/144F, 90D/144F, 120D/288F and 300D/574F, and
the backing yarns are yarns selected from fully drawn yarns having a weight of approximately 68D-100D or draw textured yarns having a weight of approximately 100D-150D.

5. The method of claim 3 wherein said face yarns and said backing yarns have a ratio of 4:1 by weight.

6. The method of claim 4 wherein said face yarns and said backing yarns have a ratio of 4:1 by weight.

7. The method of claim 5 wherein:
said brushing includes brushing in a frontward direction and brushing in a backward direction opposite of said frontward direction;
said first setting process includes heat-setting between approximately 120-130° C. at a rolling speed of 25 m/min;
said singeing process includes passing said greige cloth across hot singe rollers in frontward, backward, backward, frontward, backward and backward directions, sequentially; and
said second setting process includes heat-setting between approximately 170-180° C. at a rolling speed of 25 m/min.

8. The method of claim 6 wherein:
said brushing includes brushing in a frontward direction and brushing in a backward direction opposite of said frontward direction;
said first setting process includes heat-setting between approximately 120-130° C. at a rolling speed of 25 m/min;
said singeing process includes passing said greige cloth across hot singe rollers in frontward, backward, backward, frontward, backward and backward directions, sequentially; and
said second setting process includes heat-setting between approximately 170-180° C. at a rolling speed of 25 m/min.

9. The method of claim 7 wherein said dyeing comprises the substeps of:
bathing in dye fluid, and
rinsing with water having a neutral pH or a low acidity that will result in the dyed greige cloth having a smooth and bright surface.

10. The method of claim 8 wherein said dyeing comprises the substeps of:
bathing in dye fluid, and
rinsing with water having a neutral pH or a low acidity that will result in the dyed greige cloth having a smooth and bright surface.

11. The method of claim 10 wherein
the softening process includes:
washing to add acidity until the greige cloth is soft, and neutralizing the pH of the acidified greige cloth;
the drying process includes drying at approximately 190° C. at a rolling speed of 20 m/min with an upper drying channel operated at 300 rpm and a lower drying channel operated at 1200 rpm;
the brushing process includes two brushing cycles;
the stentering process includes stentering in a frontward direction and in a backward direction, sequentially;
the heat-setting process includes heat-setting at approximately 150° C. at a rolling speed of 25 m/min;
the singeing process includes passing said greige cloth across hot singeing rollers in backward, backward, frontward, frontward, backward, frontward, backward and frontward directions, sequentially;
the shearing process includes shearing in frontward, backward, backward, frontward, frontward, frontward, backward and backward directions, sequentially, such that the final orientation of the pile hair is the same when approaching the cloth from both frontward and backward directions; and
the final heat-setting process includes heat-setting at approximately 190° C. at a rolling speed of 30 m/min.

12. The method of claim 9 wherein
the softening process includes:
washing to add acidity until the greige cloth is soft, and neutralizing the pH of the acidified greige cloth;
the drying process includes drying at approximately 190° C. at a rolling speed of 20 m/min with an upper drying channel operated at 300 rpm and a lower drying channel operated at 1200 rpm;
the brushing process includes two brushing cycles;
the stentering process includes stentering in a frontward direction and in a backward direction, sequentially;
the heat-setting process includes heat-setting at approximately 150° C. at a rolling speed of 25 m/min;
the singeing process includes passing said greige cloth across hot singeing rollers in backward, backward, frontward, frontward, backward, frontward, backward and frontward directions, sequentially;
the shearing process includes shearing in frontward, backward, backward, frontward, frontward, frontward, backward and backward directions, sequentially, such that the final orientation of the pile hair is the same when approaching the cloth in both frontward and backward directions; and
the final heat-setting process includes heat-setting at approximately 190° C. at a rolling speed of 30 m/min.

13. A method of manufacturing a velvet plush article, comprising the steps of:
weaving a greige cloth by interweaving face yarns and backing yarns, said face yarns comprising single-ply trilobal yarns or two-ply yarns and said backing yarns comprising fully drawn yarns or draw-textured yarns;
pre-processing by sequentially brushing, first setting, singeing and second setting said greige cloth;
dyeing the pre-processed greige cloth to form a colored cloth; and
finishing by sequentially softening, drying, brushing, heat-setting, singeing, shearing and final heat-setting said colored greige cloth to form a finished velvet plush article having pile hair that is uni-directional, smooth and soft.

14. The method of claim 13 further comprising the process of stentering between said brushing and said heat-setting processes in said finishing step, said velvet plush article having a flat body including a middle layer and two pile layers, each pile layer having pile hair that is uni-directional, smooth and soft.

15. The method of claim 13 further comprising the step of printing on said colored cloth.

16. The method of claim 13 wherein said single-ply trilobal yarns are selected from the group of yarns having linear mass densities of 75D/144F, 90D/144F, 120D/288F and 300D/574F, and said backing yarns are yarns selected from fully drawn yarns having a weight of approximately 68D-100D or draw textured yarns having a weight of approximately 100D-150D.

17. The method of claim 13 wherein said face yarns and said backing yarns have a ratio of 4:1 by weight.

18. The method of claim 13 wherein said brushing process includes brushing in a frontward direction and brushing in a backward direction;

said first setting process includes heat-setting between approximately 120-130° C. at a rolling speed of 25 m/min;

said singeing process includes passing the greige cloth across hot singe rollers in frontward, backward, backward, frontward, backward and backward directions, sequentially; and said second setting process includes heat-setting between approximately 170-180° C. at a rolling speed of 25 m/min.

19. The method of claim 13 wherein said dyeing step comprises the substeps of:

bathing said pre-processed greige cloth in a dye solution, and neutralizing the pH of said greige cloth to give the dyed greige cloth a smooth and bright surface.

20. The method of claim 13 wherein the softening process includes:

washing to add acidity until the greige cloth is soft, and neutralizing the pH of the acidified greige cloth;

the drying process includes drying at approximately 190° C. at a rolling speed of 20 m/min with an upper drying channel operated at 300 rpm and a lower drying channel operated at 1200 rpm;

the heat-setting process includes heat-setting at approximately 150° C. at a rolling speed of 25 m/min;

the singeing process includes passing said greige cloth across hot singeing rollers in backward, backward, frontward, frontward, backward, frontward, backward and frontward directions, sequentially;

the shearing process includes shearing in frontward, backward, backward, frontward, frontward, frontward, backward and backward directions, sequentially, such that the final orientation of the pile hair is the same when approaching the cloth in both frontward and backward directions; and the final heat-setting process includes heat-setting at approximately 190° C. at a rolling speed of 30 m/min.

* * * * *